US008129920B2

(12) United States Patent
Sasakawa

(10) Patent No.: US 8,129,920 B2
(45) Date of Patent: Mar. 6, 2012

(54) DISCHARGE LAMP BALLAST AND FIXTURE WITH CONTROLLED PREHEATING

(75) Inventor: Tomohiro Sasakawa, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 433 days.

(21) Appl. No.: 12/491,083

(22) Filed: Jun. 24, 2009

(65) Prior Publication Data

US 2009/0322246 A1 Dec. 31, 2009

(30) Foreign Application Priority Data

Jun. 24, 2008 (JP) ..... 2008-165057

(51) Int. Cl.
*H05B 41/26* (2006.01)

(52) U.S. Cl. ..... 315/287; 315/309

(58) Field of Classification Search ..... 315/272, 315/276, 287, 291, 307, 309
See application file for complete search history.

(56) References Cited

U.S. PATENT DOCUMENTS 6,339,299 B1 * 1/2002 Wu et al. ..... 315/244
6,972,531 B2 * 12/2005 Krummel ..... 315/309
2004/0012498 A1 * 1/2004 Peck et al. ..... 340/640
2008/0088240 A1 * 4/2008 Schwannecke et al. ..... 315/46

FOREIGN PATENT DOCUMENTS

JP 2002056995 2/2002

* cited by examiner

*Primary Examiner* — Don Le
(74) *Attorney, Agent, or Firm* — Waddey & Patterson, P.C.; Mark J. Patterson

(57) ABSTRACT

Electrical characteristics associated with a filament resistance are detected to control a preheating amount so as to heat a filament into an optimum state for emission in accordance with determined preheating time. A ballast for a discharge lamp includes an inverter including at least one or more switching elements connected to an output end of a DC power source, a control circuit or controlling switching in the inverter, a resonant circuit connectable to a discharge lamp with a thermionic cathode, a load circuit connected to an output end of the inverter, a preheating circuit for preheating a filament of the discharge lamp, and a detection circuit for detecting electrical characteristics associated with a filament resistance of the discharge lamp. The electrical characteristics associated with a filament resistance are detected by the detection circuit to control a preheating amount for the filament, in accordance with a filament resistance value and determined preheating time, so that a ratio of a hot resistance Rh to a cold resistance Rc in the filament falls in a range of 4.0 or more and less than 5.5.

3 Claims, 5 Drawing Sheets

DISCHARGE LAMP BALLAST AND FIXTURE WITH CONTROLLED PREHEATING

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japanese Patent Application No. JP2008-165057 filed Jun. 24, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to electronic ballasts for lighting a discharge lamp by high-frequency power, and a lamp fixture using the ballast.

Conventional fluorescent lamp fixtures are generally realized such that an individually stored discharge lamp lighting device, e.g., a ballast, causes a preheating current to flow in a discharge lamp filament. The ballast applies a starting voltage after a preheating period to light the discharge lamp. The filament heating conditions during preheating are known to influence lamp life. Lighting (or starting) a lamp with insufficient heating (cold start) will result in a shorter filament life due to sputtering. Excessively heating the filament also causes emissive evaporation in the filament. This can also shorten filament life.

Japanese Unexamined Patent Publication No. 2002-56995 discloses a preheating power source for preheating a filament by a current source, a preheating control circuit for controlling an output of the preheating power source, and a filament voltage detection circuit. This disclosure proposes that an output of the preheating power source and a period of preheating time are changed to prevent the filament voltage from exceeding a predetermined voltage during the preheating period. It is therefore possible to ensure a reasonable lamp life.

A lamp voltage is detected to avoid end glow occurring in the lamp filaments and to prevent the lamp voltage from exceeding a predetermined value (as in Japanese Unexamined Patent Publication No. 2002-56995). However, different filament heating conditions are observed in the same type of lamps due to variations in the filament resistance value. Accordingly, a lamp filament may not be heated to allow an optimum emission start.

For example, a cathode characteristic (i.e. filament characteristic) of a FHP32 lamp includes a resistance value with variations of 9.0Ω to 16.0Ω when a filament current is 0.4 A. A preheating current is subjected to a constant current control in the conventional example. Due to filament variations, filament power can vary up to 1.8 times from nominal due to filament variations. Therefore, a different filament heating condition (i.e. electrode temperature) is observed in preheating, and insufficient heating (i.e. cold start) may occur depending on filament variations. Cold start becomes a cause of a shorter lamp life.

Moreover, a filament voltage in only one of two filaments has been conventionally detected, but two of the filaments do not necessarily have the same filament characteristics. In the case where a resistance value is made larger due to variations in two filaments arranged in the same lamp, end glow may possibly occur in one but not both of the filaments. In this case, lamp life cannot be necessarily ensured.

Each lamp may thus have a different life due to filament variations in the conventional example, wherein a non-lighting lamp needs to be replaced frequently at the end of a lamp life. Accordingly, maintenance costs are increased.

The conventional example is also accompanied by different preheating times due to filament variations, which causes a problem that each lamp is lit (or started) at different timing in the case of using a plurality of discharge lamp lighting devices in a same illumination space, making users feel a sense of incompatibility.

The conventional example which focuses attention on end glow being a discharge phenomenon among filaments monitors a filament voltage to prevent the voltage from reaching a fixed value or higher to avoid end glow as stated above, but an optimum heating state (or electrode temperature) for emission is not necessarily realized due to filament (or resistance value) variations in each lamp. It is because an optimum filament state for emission is merely defined by an electrode temperature.

BRIEF SUMMARY OF THE INVENTION

The present invention has achieved by taking the above problems into consideration, and an object thereof is to provide a discharge lamp ballast which is capable of realizing a consistent preheating time regardless of filament variations in each lamp. This is accomplished by preheating a filament into an optimum state for emission through detection of an electrical characteristic associated with a filament resistance and controlling filament preheating so as not to generate end glow at the filaments or emitter evaporation, so as to provide rated lamp life.

A first aspect of the present invention is characterized by including an inverter including at least one or more switching elements connected to an output end of a DC power source, a control circuit for controlling switching in the inverter, a resonant circuit connectable to a discharge lamp with a thermionic cathode, a load circuit connected to an output end of the inverter, a preheating circuit for preheating a filament of the discharge lamp, and a detection circuit for detecting an electrical characteristic associated with a filament resistance of the discharge lamp. An electrical characteristic associated with a filament resistance is detected by the detection circuit to control preheating of the filament, in accordance with a filament resistance value and a determined preheating time, so that a ratio of a hot resistance to a cold resistance in the filament falls in a range of 4.0 or more and less than 5.5.

A second aspect of the present invention is based on the first aspect of the present invention and is characterized by detecting the electrical characteristics associated with the filament resistance at the time of constant heating during lighting of a lamp, and determining an amount of a preheating current for use in subsequent preheating from a relationship between pre-determined filament voltage, filament current characteristic in preheating, and the electrical characteristic associated with a filament resistance in constant preheating.

A third aspect of the present invention is a lamp fixture characterized by including the ballast according to the first or second aspect and a discharge lamp exhibiting a lighting operation controlled by the discharge lamp lighting device.

According to the first aspect of the present invention, an electrical characteristic associated with a filament resistance is detected to control a preheating output so that a ratio of a hot resistance to a cold resistance in the filament in a preheating period falls in a range of 4.0 or more and less than 5.5, thereby providing rated service life of a lamp even if large variations are observed in the filament characteristic (i.e. resistance value). Accordingly, time and costs spent for maintenance accompanied by the end of a lamp life can be reduced. A preheating amount is also controlled, in a determined period of preheating time, so that a ratio of a heat resistance to a cold resistance in the filament falls in a range of 4.0 or more and less than 5.5, thereby allowing lighting of multiple lamps at the same timing without making users feel a sense of incompatibility in using the lamps.

According to the second aspect of the present invention, detection of a filament characteristic (or resistance value) during lamp ignition enables the device to preset a preheating output in filament preheating and realize a consistent preheating time.

DETAILED DESCRIPTION OF THE INVENTION

Figure 1:
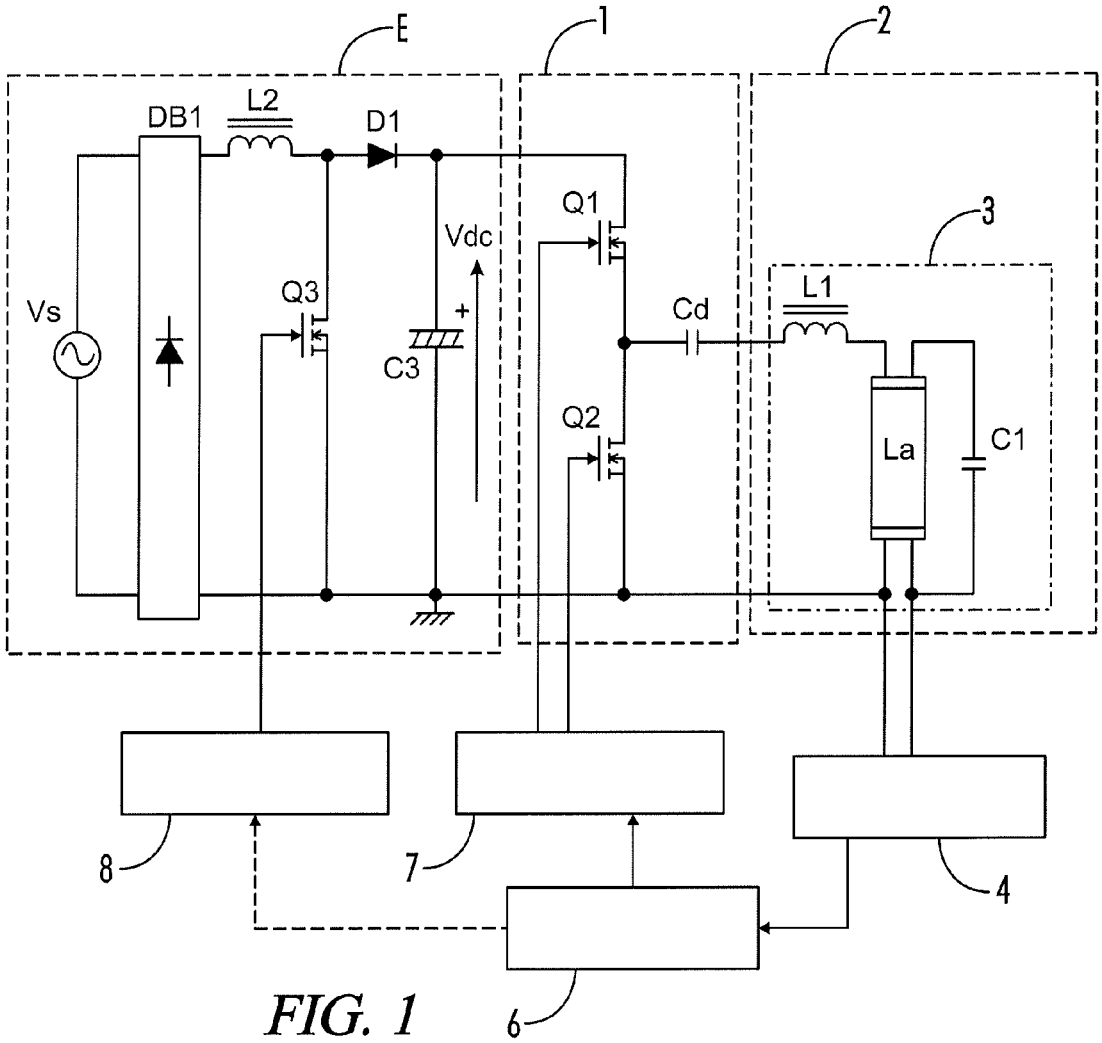
FIG. 1 is a circuit diagram showing a first embodiment of the present invention.

FIG. 1 is a circuit diagram showing a first embodiment of the present invention. The present circuit includes a DC power source E having a fixed output voltage, an inverter 1 connected to an output end of the DC power source E, a load circuit 2 including a resonant circuit 3 connected to an output end of the inverter 1 and a discharge lamp La, a filament voltage detection circuit 4, control circuits 7 and 8 for the inverter 1 and the DC power source E, and a microcontroller 6 for providing command signals to each of the control circuits 7 and 8.

The DC power supply E uses a step-up chopper circuit. The step-up chopper circuit includes a diode bridge DB1 for subjecting a commercial AC power source Vs to full-wave rectification, a series circuit including an inductor L2, and a switching element Q3 to be connected to a rectified output of the diode bridge DB1, and a series circuit including a diode D1 and a smoothing capacitor C3 to be connected across the switching element Q3 as shown in FIG. 1. The switching element Q3 is controlled to be turned on/off by the control circuit 8 using a frequency which is sufficiently higher than that of the AC power source Vs. Using the present circuit allows an output voltage Vdc of the DC power source E to be fixed at a value which is a peak value of the commercial AC power source Vs or higher. Based on commands from the microcontroller 6 to the control circuit 8, the chopper output Vdc can be fixed or variable.

The inverter 1 has a series circuit including switching elements Q1 and Q2 connected in parallel to an output of the DC power source E, and a DC-blocking capacitor Cd which is connected between a connection point of the switching elements Q1 and Q2 and an inductor L1. The switching elements Q1 and Q2 are driven to be turned on/off alternately by the control circuit 7 using a high frequency.

The resonant circuit 3 can be a series resonant circuit including the inductor L1 and a capacitor C1, wherein frequency changes in the inverter 1 away from resonance cause a change in power supplied to the discharge lamp La because of the characteristics of the resonant circuit 3. In preheating mode, an operation frequency in the inverter 1 is set to be sufficiently higher than an unloaded resonant frequency in the resonant circuit 3. A voltage lower than a starting voltage is applied to both ends of the discharge lamp La, and a preheating current is made to flow in each filament of the discharge lamp La via the resonant capacitor C1. That is, filaments in both electrodes of the discharge lamp La are connected in series to both ends of the capacitor C1, and a current flowing into the capacitor C1 is also made to flow in each of the filaments so as to preheat each of the filaments.

When a preheating period is finished to enter a starting mode, an operation frequency of the inverter 1 decreases to a frequency which is close to an unloaded resonant frequency of the resonant circuit 3, and a voltage higher than a starting voltage is applied to both ends of the discharge lamp La, thereby lighting the discharge lamp La. The impedance between both ends of the discharge lamp La is therefore decreased, followed by decreasing Q of the resonant circuit 3 along with a decreased peak of a resonance characteristic and causing a lighting resonant frequency to be lower than an unloaded resonant frequency. During lighting of the discharge lamp La, an operation frequency in the inverter 1 is appropriately set so as to allow full lighting and dimmed lighting of the discharge lamp La by a frequency which is higher than a lighting resonant frequency (i.e. delay mode)

The filament voltage detection circuit 4 monitors a filament voltage Vf during the preheating period and an output of the filament voltage detection circuit 4 is outputted to the control circuit 7 via the microcontroller 6.

Figure 2A:
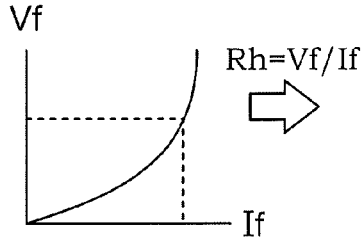
FIGS. 2*a* and 2*b* graphically represent filament current and voltage operation (FIG. 2*a*) and Rh/Rc relationships (FIG. 2*b*) according to the first embodiment of the present invention.

It is known that a filament temperature is calculated by a ratio of a hot resistance to a cold resistance (Rh/Rc) which serves as a filament characteristic. As shown in FIG. 2*a*, a filament voltage Vf obtained when a current If is supplied to a filament is measured to correspond to a filament temperature (Th). The hot temperature Th is expressed by the following equation:

$$Th\ (K)=Tc\ (K)\times(Rh/Rc)0.814$$

Rc: Cold resistance=Rh (in 5 mA)

Tc: Cold temperature (K; Kelvin)

Rh: Hot resistance

Th: Hot temperature (K; Kelvin)

Figure 2B:
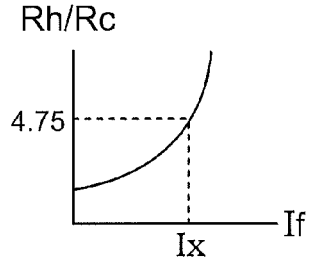

The hot temperature (Th) obtained when Rh/Rc is 4.0 owing to characteristics of a metal (i.e. tungsten) used as a cathode corresponds to an emission starting temperature. The hot temperature (Th) obtained when Rh/Rc is 5.5 corresponds to an emitter evaporation starting temperature. Accordingly, a hot temperature obtained therebetween when Rh/Rc is 4.75 (FIG. 2*b*) can be said to be an optimum preheating condition.

Figure 3:
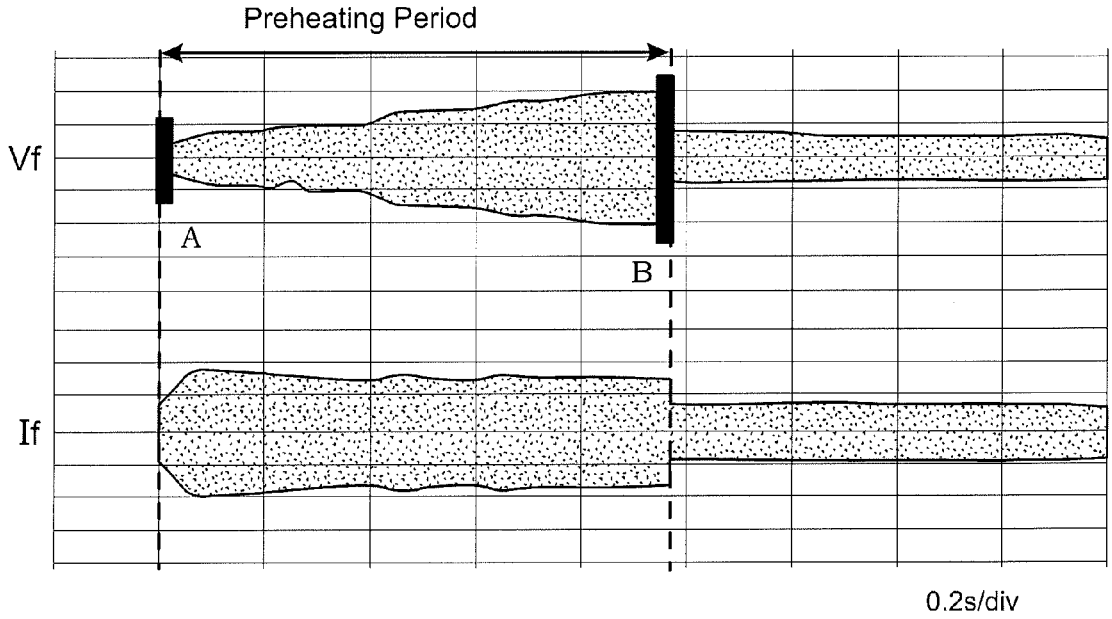
FIG. 3 is a waveform diagram showing operation according to the first embodiment of the present invention.

FIG. 3 is a waveform diagram showing the filament voltage Vf and the filament current If during the preheating period according to the present embodiment. The preheating circuit according to the present embodiment employs a capacitor preheating system with a fixed inverter operation frequency during the preheating period, so that the filament current during the preheating period substantially operates as a constant current. Accordingly, preheating is continued until the filament voltage Vf is brought into a range of 4 to 5.5 times more than the filament voltage Vf obtained immediately after starting preheating in the present embodiment. The period immediately after starting preheating is shown as Section A in FIG. 3. The filament voltage in Section B is finally brought into a range of 4 to 5.5 times more than the filament voltage in Section A. In the case of having a low resistance value due to filament variations, the preheating time is increased.

If Rh/Rc does not reach 4.0 or higher after passing a fixed period of time, the inverter operation frequency is changed to a direction in which a preheating current is increased (or to a low frequency side in a general delay operation), or Rh/Rc is brought into a range of 4.0 to 5.5 by increasing the chopper output voltage Vdc.

Moreover, in the case of having a high resistance value due to filament variations, a discharge lamp is started by shifting to a starting mode in a shorter period of time than a normal period of the preheating time to avoid emitter evaporation and end glow.

Note that the preheating current is adjusted so that Rh/Rc falls in a range of 4.0 to 5.5 by a determined preheating time (e.g. 1 second) from subsequent preheating. For example, an amount of a preheating current can be changed by setting a frequency in preheating and the chopper output voltage Vdc to be variable. In response to an output from the filament voltage detection circuit 4, the microcontroller 6 compares it with stored data and determines whether a preheating current for use at the next operation should be increased, decreased or maintained without making any changes.

As described above, the present embodiment makes it possible to perform optimum preheating to start emission by estimating an electrode temperature through detection of a ratio of the hot resistance Rh to the cold resistance Rc (Rh/Rc). A preheating current for use from the next operation is also made variable so as to realize a substantially consistent preheating time regardless of filament variations.

Figure 4:
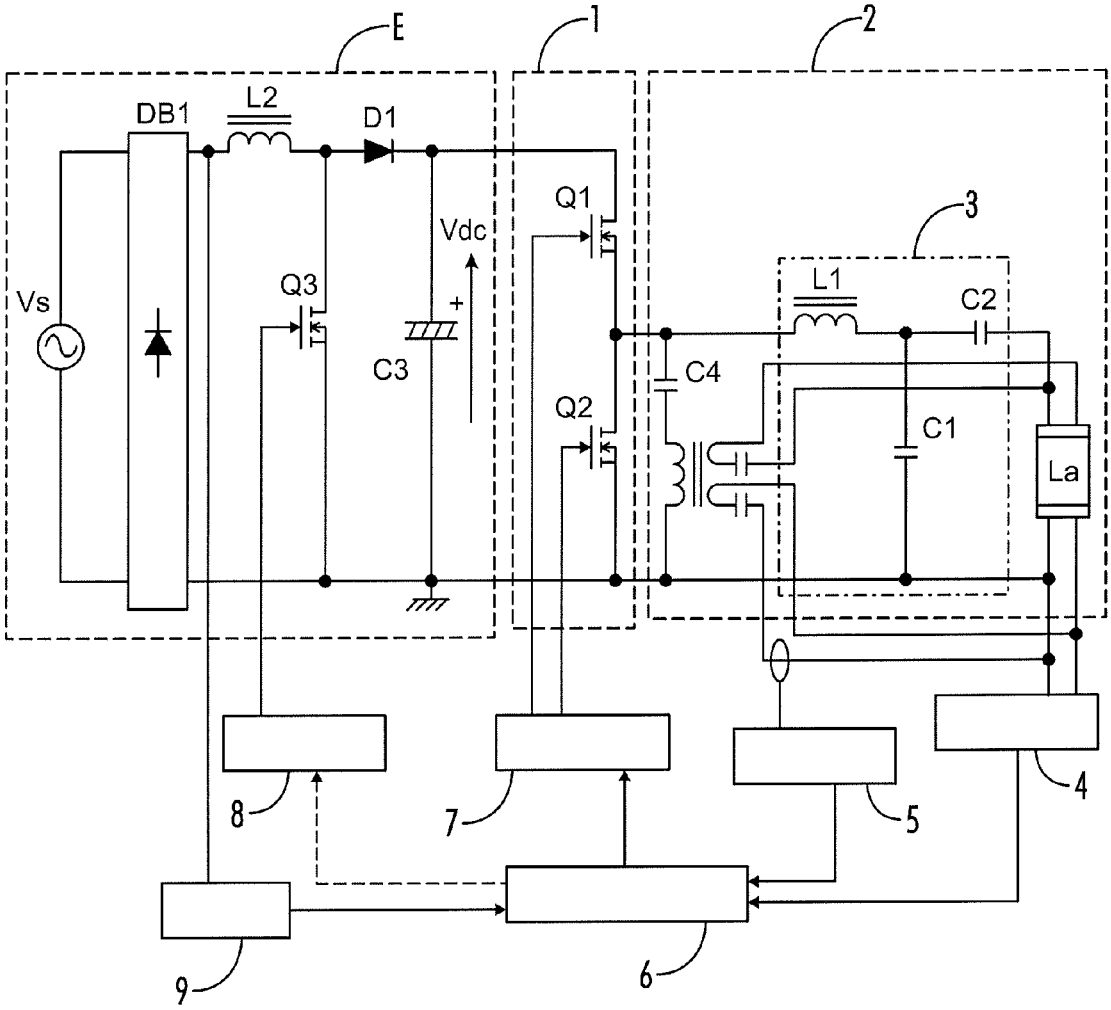
FIG. 4 is a circuit diagram showing a second embodiment of the present invention.

FIG. 4 shows a circuit diagram according to a second embodiment of the present invention. In this embodiment, a filament current detection circuit 5 is included and a flickering (cycle) counter 9 for counting the number of flickering (cycles) in the discharge lamp La is provided, in addition to the filament voltage detection circuit 4. The preheating circuit also employs a preheating transformer system in place of a capacitor preheating system. A primary winding of a preheating transformer is connected to both ends of the switching element Q2 via a capacitor C4, and a pair of second windings of the preheating transformer is connected to filaments in the electrodes of the discharge lamp La via a preheating capacitor respectively. Although costs and a component area are generally increased in the preheating transformer system in comparison with the capacitor preheating system, there are operational advantages.

As opposed to the prior embodiment which detects only a filament voltage, the present embodiment employs the preheating transformer system as a preheating system without carrying out a constant current control, wherein both the filament current If and the filament voltage Vf are detected to calculate a filament resistance (Vf/If) inside the microcontroller 6.

Figure 5:
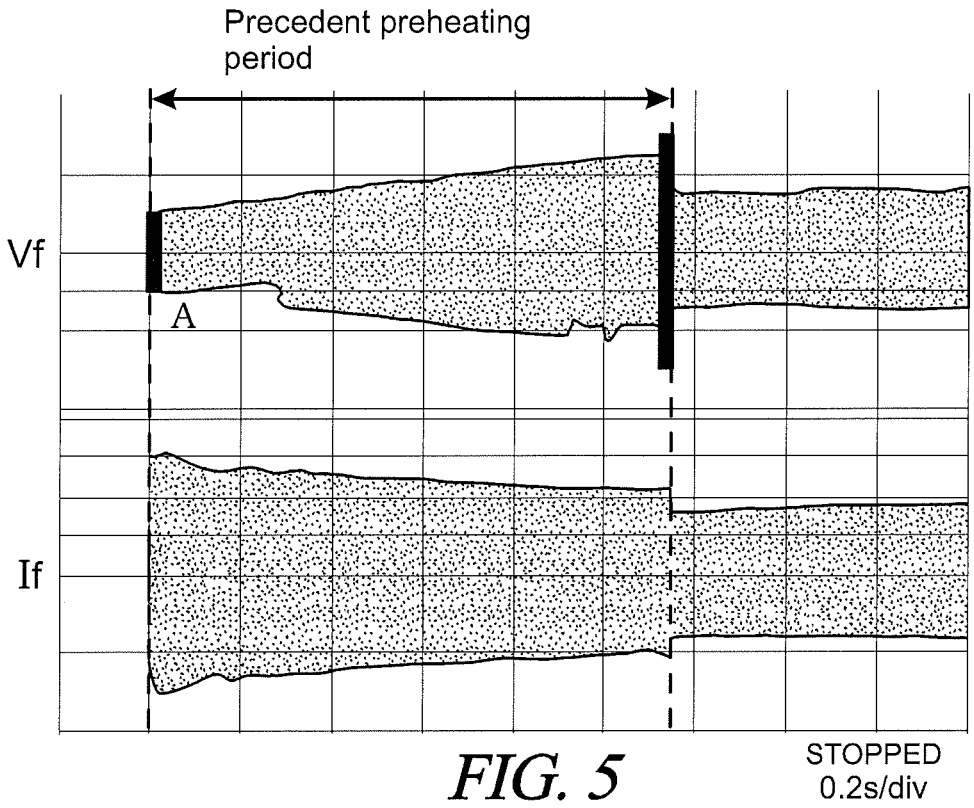
FIG. 5 is a waveform diagram showing operation according to the second embodiment of the present invention.

FIG. 5 shows waveforms of the filament voltage Vf and the filament current If in the preheating period according to the present embodiment. Because the present embodiment employs a preheating transformer system, the filament current If changes with the lapse of time. When the filament is heated and a resistance value is increased, the filament current is decreased and the filament voltage Vf is increased accordingly. Therefore, both the filament current If and the filament voltage Vf are detected in the present embodiment to calculate a filament resistance value by an arithmetic function in the microcontroller 6.

On the assumption that a filament resistance value in a section A in FIG. 5 is Rc and a filament resistance value in preheating in a section B is Rh, preheating is continued until Rh/Rc falls in a range of 4.0 to 5.5.

The counter 9 for accumulating the number of cycles (flickering) in the discharge lamp La also outputs a signal to the microcontroller 6 for every predetermined number of times. The microcontroller 6 detects a filament characteristic (i.e. resistance value) and adjusts a preheating output by changing an inverter operation frequency in preheating so that Rh/Rc falls in a range of 4.0 to 5.5 within a predetermined period of time (e.g. 1 second). Since a filament has a resistance value (or heating state) which changes in accordance with a reduction in the emitter, the microcontroller 6 determines a condition of the filament (or reduction in the emitter) periodically by using the counter 9 so as to adjust an appropriate amount of the preheating current.

As stated above, the present invention makes it possible to accurately detect a ratio of the hot resistance Rh to the cold resistance Rc (Rc/Rh) in the lamp filament, thereby enabling rated lamp life even in various types of preheating circuits. A periodic detection of filament conditions also realizes optimum filament preheating more accurately, in addition to allowing lighting of multiple lamps at the same time.

Although the filament voltage detection circuit 4 and the filament current detection circuit 5 are arranged only in one of two filaments (i.e. filament on a low voltage side) in the present embodiment, arranging similar detection circuits in the remaining filament (i.e. filament on a high voltage side) for individual preheating control in each of the filaments makes it possible to carry out further accurate optimum preheating for each of the filaments without having effects of filament variations.

Figure 6:
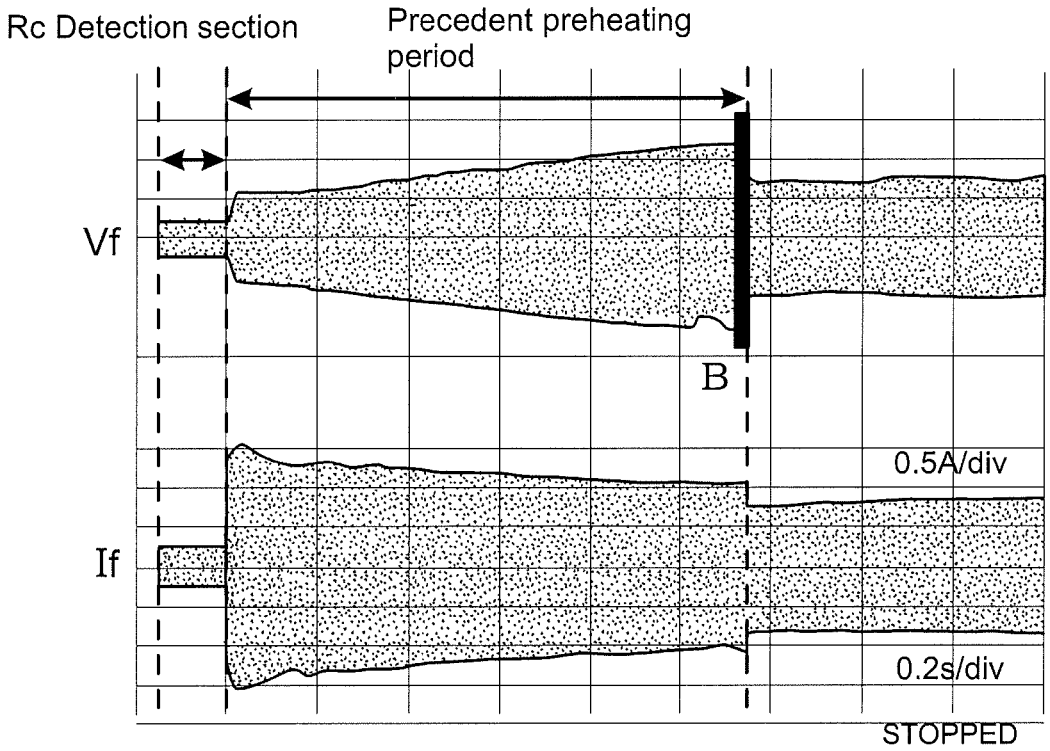
FIG. 6 is a waveform diagram showing another operation according to the second embodiment of the present invention.

The cold resistance Rc may also be calculated with further high accuracy by setting a period to detect the filament cold resistance Rc prior to starting preheating as shown in FIG. 6 rather than setting a period to detect the filament cold resistance Rc in starting preheating (e.g. section A in FIG. 5), and causing a small current (e.g. 5 mA) to flow in the filament by a constant current power source to detect a filament voltage.

Figure 7:
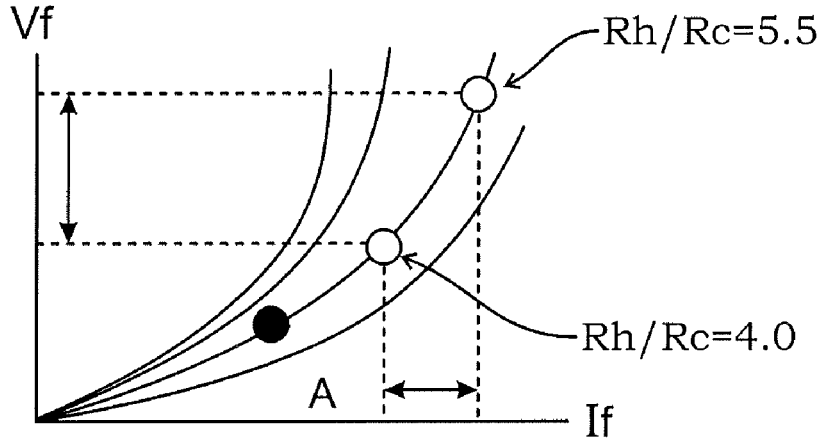
FIG. 7 is a graph representing operation of the ballast according to a third embodiment of the present invention.

FIG. 7 is a diagram to explain an operation according to a third embodiment of the present invention. The circuit shown in FIG. 4 may be used. Since the present embodiment detects a filament characteristic (i.e. resistance value) in lighting a discharge lamp, a preheating amount in subsequent preheating cycles can be preset. FIG. 7 shows data which is stored in a table in microcontroller 6 and which is used to compare filament voltage—filament current characteristics obtained in lighting with filament voltage—filament current characteristics obtained when Rh/Rc falls in a range of 4.0 to 5.5 at preheating time of one second. In the present embodiment, the filament voltage Vf and the filament current If obtained immediately before turning off the power source are compared with those in the table stored in the microcontroller 6 so as to estimate Rh/Rc in filament preheating.

For example, in FIG. 7, it is assumed that a value of each of the filament voltage Vf and the filament current If obtained immediately before turning off the power source in the ballast corresponds to a point A. The filament current If at point A is a constant preheating current. In this case, a preheating current with Rh/Rc in a range of 4.0 to 5.5 for a preheating time of 1 second is estimated by a curve passing through the point A. In the example of FIG. 7, a subsequent preheating current is set at an intermediate point between a first white circle on the curve passing through the point A (in which Rh/Rc falls in 4.0 for preheating time of 1 second) and a second white circle (in which Rh/Rc falls in 5.5 for a preheating time of 1 second). In supplying power at the next lamp operation, the microcontroller 6 commands the control circuit 7 to set an inverter operation frequency in preheating or commands the control circuit 8 to change the chopper output voltage Vdc so as to realize a desired preheating current.

The present embodiment obtains the filament characteristic at the time of lighting (or constant preheating) as stated above, thereby realizing desired filament preheating at determined preheating time (e.g. 1 second) every preheating cycle. Accordingly, multiple discharge lamps in respective lamp fixtures can be lit simultaneously.

Figure 8:
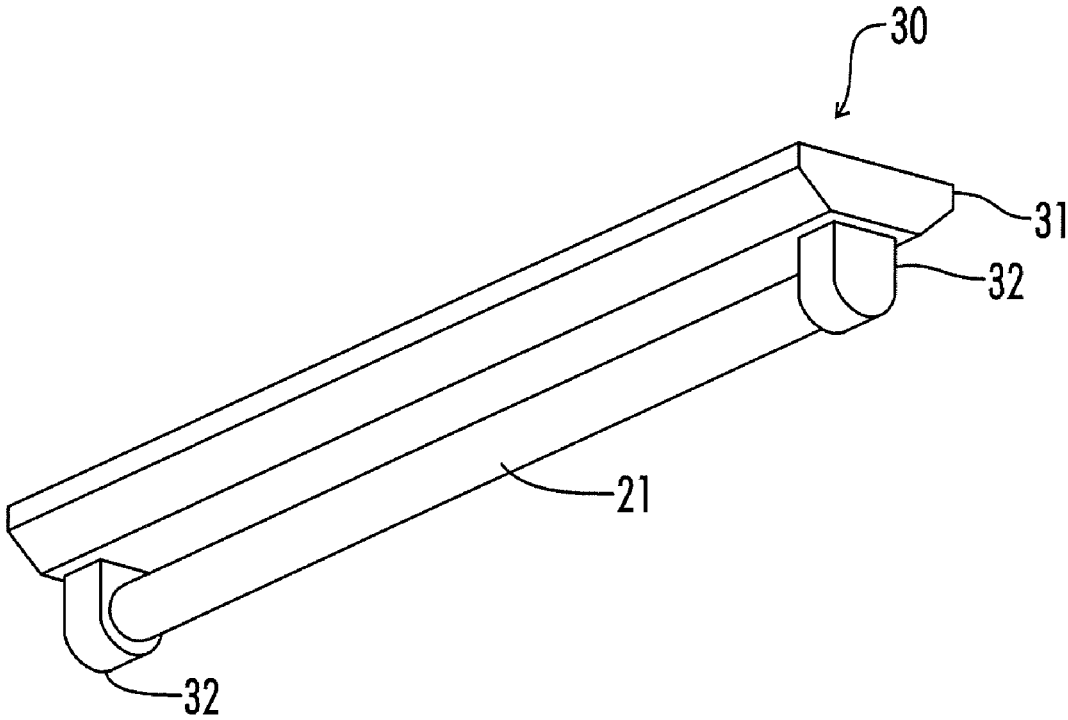
FIG. 8 is a perspective view of a lamp fixture according to an embodiment of the present invention.

FIG. 8 shows a lamp fixture onto which the ballast according to any one of the described embodiments is mounted. A lamp fixture 30 has a fixture main body 31 into which the ballast according to any one of the embodiments is integrated, and a pair of sockets 32 used to electrically connect the ballast and the discharge lamp, wherein a filament electrode of a discharge lamp 21 with a thermionic cathode is mounted to be attachable/detachable to each of the sockets 32. Although a straight tube fluorescent lamp is exemplified here as a load, the present invention may also be applied to lighting devices for circular fluorescent lamps and double-ring fluorescent lamps. The present invention may also be structured as a lighting system capable of realizing simultaneous lighting with one wall switch or a sensor by connecting a plurality of illumination fixtures 30 arranged in a same lighting space to the same power source system.

Thus, although there have been described particular embodiments of the present invention of a new and useful Discharge Lamp Ballast and Fixture with Controlled Preheating, it is not intended that such references be construed as limitations upon the scope of this invention except as set forth in the following claims.

What is claimed is:

1. A discharge lamp lighting device comprising:

an inverter part including at least one or more switching elements connected to an output end of a DC power source;

a control circuit for controlling switching in the inverter part;

a load circuit including a resonance circuit connectable to a discharge lamp with a thermionic cathode and being connected to an output end of the inverter part;

a preheating circuit for preheating a filament of the discharge lamp; and a detection circuit for detecting an electrical characteristic associated with a filament resistance of the discharge lamp, wherein an electrical characteristic associated with a filament resistance are detected by the detection circuit to control a preheating amount for the filament, in accordance with a filament resistance value and a determined preheating time, so that a ratio of a hot resistance to a cold resistance in the filament falls in a range of 4.0 or more and less than 5.5.

2. The discharge lamp lighting device according to claim 1, wherein the electrical characteristics associated with the filament resistance are detected in constant preheating during lighting of a lamp and an amount of a preheating current in subsequent preheating is determined from a relationship between prestored filament voltage—filament current characteristic in preheating and the electrical characteristic associated with a filament resistance in constant preheating.

3. An illumination fixture including the discharge lamp lighting device according to any of claims 1 and 2, and a discharge lamp exhibiting a lighting operation controlled by the discharge lamp lighting device.

* * * * *